United States Patent [19]

Lang

[11] Patent Number: 4,880,232

[45] Date of Patent: Nov. 14, 1989

[54] FLAG PIN GOLF BALL DISTANCE MEASURING DEVICE

[76] Inventor: James P. Lang, 11 Cedar Ct., Mobile Manor, Richmond, Ind. 47374

[21] Appl. No.: 216,401

[22] Filed: Jul. 8, 1988

[51] Int. Cl.[4] ..... A63B 57/00

[52] U.S. Cl. ..... 273/32 B; 273/34 R; 273/DIG. 21; 33/759; 33/760

[58] Field of Search ..... 273/34 R, DIG. 21, 32 B, 273/177 R, 32 R; 33/138, 180, 508, 1 LE, 137 R; 116/173, 174, 175

[56] References Cited

U.S. PATENT DOCUMENTS

| | | | |
|---|---|---|---|
| 663,761 | 12/1900 | Johnson | 273/34 R |
| 672,395 | 4/1901 | Felton | 273/34 R |
| 2,041,119 | 5/1936 | Duganne | 273/DIG. 21 |
| 2,110,101 | 3/1938 | Weber | 273/34 R |
| 3,067,717 | 12/1962 | Imparato | 273/34 R X |
| 3,204,599 | 9/1965 | Milosch | 273/34 R |
| 3,436,077 | 4/1969 | Geram | 273/34 R |
| 3,604,711 | 9/1971 | Hansburg | 273/DIG. 21 |
| 4,273,329 | 6/1981 | Trigg et al. | 273/DIG. 21 |
| 4,532,712 | 8/1985 | Vistain | 273/DIG. 21 |

*Primary Examiner*—George J. Marlo
*Attorney, Agent, or Firm*—Jerry T. Kearns

[57] ABSTRACT

A flag pin golf ball distance measuring device for measuring the distance of a golf ball from a hole on a putting green includes an elongated cylindrical pin having a lower end provided with a radially extending flange and dimensioned for registry with a standard golf hole cup. A hollow cylindrical sleeve is received for longitudinal sliding and rotational movement around said pin. A right angle bracket has a first leg extending parallel with a longitudinal axis of the sleeve and secured thereto. A second leg of the bracket extends perpendicular to the longitudinal axis of the sleeve and a pair of spaced parallel side walls extend perpendicularly upwardly from opposed side edges of the second leg. A spring roller type tape measure is removably received on the second leg, between the parallel side walls. A free end of a measuring tape of the tape measure is secured to the sleeve. A transversely extending cylindrical handle is attached to an upper handle of the pin. A card holder is attached to the pin adjacent the handle and includes a holder for a writing instrument.

4 Claims, 2 Drawing Sheets

FLAG PIN GOLF BALL DISTANCE MEASURING DEVICE

BACKGROUND OF THE INVENTION

1. Field of the Invention

The present invention relates to flag pin devices, and more particularly pertains to a flag pin golf ball distance measuring device for use in determining the winner of a closest to the pin golf contest. Many different golf tournaments, including professional golf tournaments include a closest to the pin contest on selected par three holes. In order to determine the winner of such a contest, the distance of each individual's ball from the hole on the putting green must be measured and recorded. Presently, the use of a tape measure and two individuals is required to perform these measurements. The present invention seeks to overcome this problem by providing a measuring device designed to be substituted for the conventional golf hole marking flag pin. Through the use of the device of the present invention, the measurement of the distance between a golf ball and the center of the hole may be quickly determined and recorded by a single individual.

2. Description of the Prior Art

Various types of flag pin devices are known in the prior art. A typical example of such a flag pin device is to be found in U.S. Pat. No. 2,110,101, which issued to L. Weber on Mar. 1, 1938. This patent discloses a golf hole marking flag which utilizes a weight suspended over the center of the hole to mark the position thereof without obstructing the hole opening. U.S. Pat. No. 3,067,717, which issued to E. Imparato on Dec. 11, 1962, discloses a portable resilient marker which may be utilized to mark the boundary limits of a golf course. The device utilizes a coiled spring having a straightened sharpened end for ground insertion. U.S. Pat. No. 3,204,599, which issued to R. Milosch on Sept. 7, 1965, discloses a golf hole marker which includes a sign body which has an oblong cylindrical shape having a central longitudinal bore through which the flag pin is received. U.S. Pat. No. 3,436,077, which issued to J. Geram on Apr. 1, 1969, discloses a golf hole marking flag which allows the flag standard to be shifted in the hole liner or cup so as to facilitate the entry of the golf ball into the liner. U.S. Pat. No. 4,273,329, which issued to D. Trigg et al on June 16, 1981, discloses a flag pin attachment including a ball distance measuring line. A housing containing a spring loaded retractable spool of line with a hooking member for attaching either the end of the line or the housing to a golf hole flag pole in order to play out the string from the spool to measure the distance between the flag stick and a golf ball on a putting green.

While the above mentioned devices are suited for their intended usage, none of these devices disclose a flag pin golf ball distance measuring device which utilizes a hollow cylindrical sleeve received for sliding movement around a pin in conjunction with a bracket for removably holding a spring roller type tape measure. Additionally, none of the aforesaid devices include an attached card holder for recording the measured distances. Inasmuch as the art is relatively crowded with respect to these various types of flag pin devices, it can be appreciated that there is a continuing need for and interest in improvements to such flag pin devices, and in this respect, the present invention addresses this need and interest.

SUMMARY OF THE INVENTION

In view of the foregoing disadvantages inherent in the known types of flag pin devices now present in the prior art, the present invention provides an improved flag pin golf ball distance measuring device. As such, the general purpose of the present invention, which will be described subsequently in greater detail, is to provide a new and improved flag pin golf ball distance measuring device which has all the advantages of the prior art flag pin devices and none of the disadvantages.

To attain this, a representative embodiment of the concepts of the present invention is illustrated in the drawings and makes use of a flag pin golf ball distance measuring device designed to replace a conventional golf hole flag pin for use on par three holes for measuring the distance of golf balls on the putting green from the hole. The device includes an elongated cylindrical pin having a lower end dimensioned for insertion into a standard golf hole cup. A hollow cylindrical sleeve is received for longitudinal sliding movement around the pin. A bracket in which a spring roller type tape measure is removably received is secured to the sliding sleeve. The free end of the measuring tape of the tape measure is fixed to the sleeve. The tape measure may be removed from the bracket and extended to determine the winner in a closest to the pin golf contest. A card holder is provided on the pin and includes a holder for a writing instrument for use in recording measured distances.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved flag pin golf ball distance measuring device which has all the advantages of the prior art flag pin devices and none of the disadvantages.

It is another object of the present invention to provide a new and improved flag pin golf ball distance measuring device which may be easily and efficiently manufactured and marketed.

It is a further object of the present invention to provide a new and improved flag pin golf ball distance measuring device which is of a durable and reliable construction.

An even further object of the present invention is to provide a new and improved flag pin golf ball distance measuring device which is susceptible of a low cost of manufacture with regard to both materials and labor, and which accordingly is then susceptible of low prices of sale to the consuming public, thereby making such flag pin devices economically available to the buying public.

Still yet another object of the present invention is to provide a new and improved flag pin golf ball distance measuring device which provides in the apparatuses and methods of the prior art some of the advantages thereof, while simultaneously overcoming some of the disadvantages normally associated therewith.

Still another object of the present invention is to provide a new and improved flag pin golf ball distance measuring device for enabling a single individual to efficiently measure and record the distance of golf balls from the center of a golf hole.

Yet another object of the present invention is to provide a new and improved flag pin golf ball distance measuring device which utilizes a longitudinally slidable sleeve having an attached bracket for removably holding a spring roller type tape measure.

Even still another object of the present invention is to provide a new and improved flag pin golf ball distance measuring device which may be easily transported and is adapted for substitution with a standard golf flag pin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
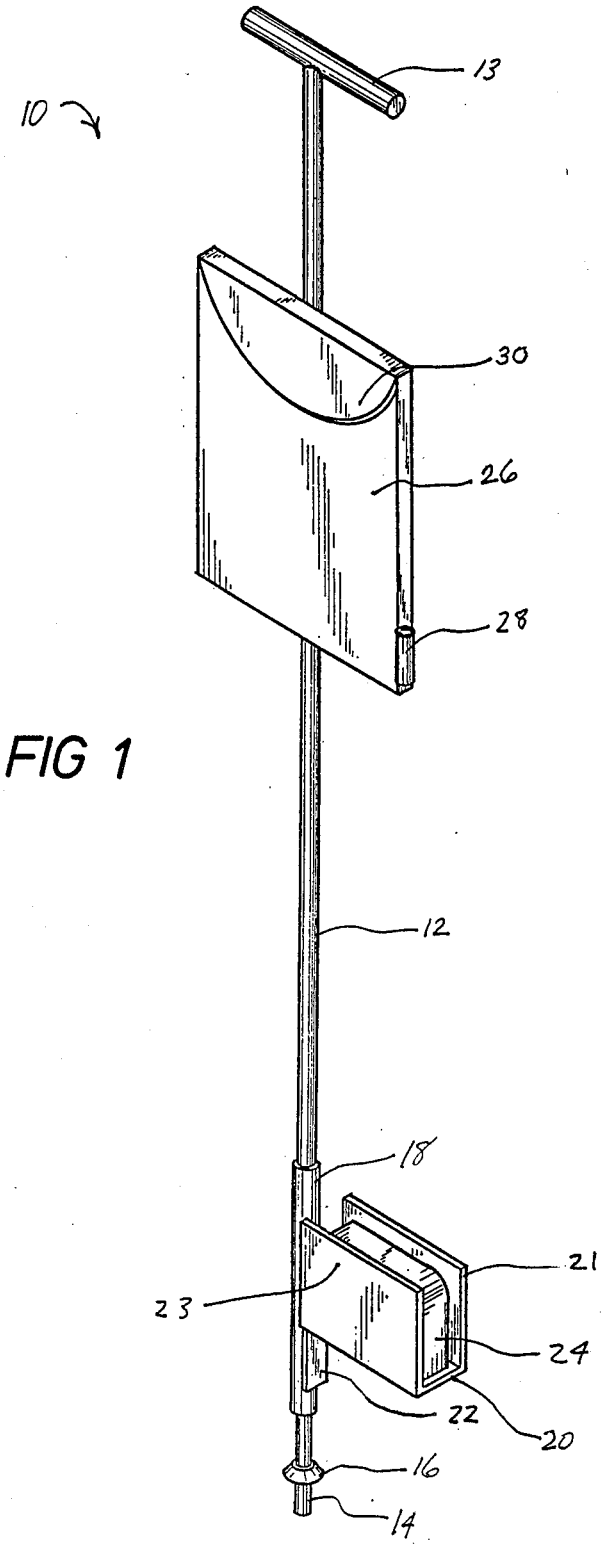
FIG. 1 is a perspective view of the flag pin golf ball distance measuring device of the present invention.

With reference now to the drawings, and in particular to FIG. 1 thereof, a new and improved flag pin golf ball distance measuring device embodying the principles and concepts of the present invention and generally designated by the reference numeral 10 will be described.

More specifically, it will be noted that the first embodiment 10 of the invention includes an elongated cylindrical pin 12. A lower end 14 of the pin 12 is dimensioned for insertion into and registry with a standard golf hole cup. A fixed radially extending flange 16 is provided on the pin 12, adjacent the lower end 14. This configuration allows the measuring device 10 of the present invention to be substituted for a standard golf flag pin hole marker. A transversely extending cylindrical handle 13 is attached to an upper end of the pin 12. The length of the pin 12 from the handle 13 to the lower end 14 is preferably about thirty inches. This allows an individual to easily insert and remove the pin 12 from a standard golf cup by grasping the handle 13. A hollow cylindrical sleeve 18 is received for longitudinal sliding movement around the pin 12. The sleeve 18 has a preferred length of about eight inches. A right angle bracket has a first leg 22 which extends parallel with a longitudinal axis of the sleeve 18 and is secured thereto. A second leg 20 of the bracket extends perpendicular to the longitudinal axis of the sleeve 18 and has a pair of spaced parallel side walls 21 and 23 extending perpendicularly upwardly from opposed side edges of the second leg 20. A spring roller type tape measure 24 is removably received on the second leg 20, between the parallel side walls 21 and 23. A card holder 26 is attached to the pin 12, adjacent the handle 13. The card holder 26 is provided with a resilient clip 30 for removably retaining a score card for recording the distance from the center of the hole of the golf balls of various individuals. A loop 28 on a side edge of the card holder 26 is provided for holding a writing instrument.

Figure 2:
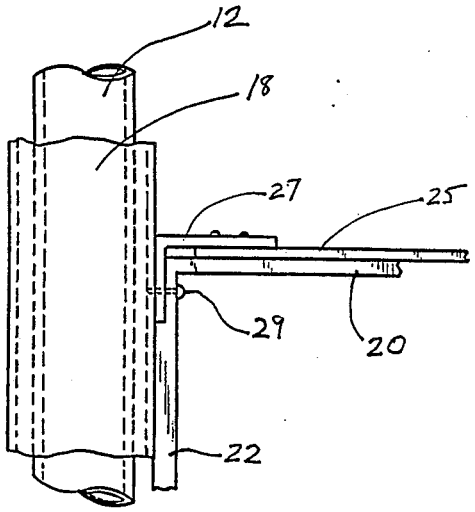
FIG. 2 is a partial cut away detail view illustrating the assembly of the longitudinally sliding hollow sleeve and tape measure mounting bracket.

As shown in FIG. 2, the free end 27 of the measuring tape 25 of the tape measure 24 is secured to the sliding sleeve 18 by a fastener 29 which extends through the first leg 22 of the tape measure mounting bracket. Thus, the free end 27 of the tape measure is positioned over the central vertical axis of a golf hole.

With reference now to FIG. 1, the manner of usage of the measuring device 10 of the present invention will now be described. Once all individual contestants have teed off on a selected par three hole, the standard hole marking flag pin is removed and replaced by the pin 12 of the device of the present invention. The tape measure 24 is removed from between the side walls 21 and 23 and is extended to measure the distance to each individual's ball. It should be noted that the sleeve 18 is free to rotate about the pin 12 and thus may be appropriately aligned with various golf balls in any direction. The measuring official then records the distance of each individual's golf balls on the card holder 26. Upon completion of the measurement process, the measuring device 10 may be removed from the hole by grasping the handle 13. After all individuals have completed putting on the particular green, the standard flag pin marker is replaced. The measuring device 10 may be then be easily transported to another selected green. Another important aspect of the present invention is the fact that the longitudinal slidable mounting of the sleeve 18 allows the device to be utilized with any depth of hole. When placed in a selected golf hole cup, the sleeve 18 slides upwardly relative to the pin 12, causing the bottom of the second leg 20 of the tape measure holding bracket to rest upon the surface of the ground.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A flag pin golf ball distance measuring device for measuring the distance of a golf ball from a hole on a putting green, comprising:

an elongated cylindrical pin;

a lower end of said pin dimensioned for insertion into and registry with a standard golf hole cup;

a hollow sleeve received for longitudinal sliding movement around said pin;

a right angle bracket having a first leg extending parallel with a longitudinal axis of said sleeve and secured thereto;

a second leg of said bracket extending perpendicular to the longitudinal axis of said sleeve;

a pair of spaced parallel side walls extending perpendicularly upwardly from opposed side edges of said second leg;

a spring roller type tape measured removably received on said second leg, between said parallel side walls; and a free end of a measuring tape of said tape measure secured to said sleeve.

2. The flag pin golf ball distance measuring device of claim 1, further comprising a transversely extending cylindrical handle attached to an upper end of said pin.

3. The flag pin golf ball distance measuring device of claim 1, further comprising a card holder attached to said pin, said card holder including means for holding a writing instrument.

4. A flag pin golf ball distance measuring device for measuring the distance of a golf ball from a hole on a putting green, comprising:

an elongated cylindrical pin;

a lower end of said pin dimensioned for insertion into and registry with a standard golf hole cup;

a fixed radially extending flange on said cylindrical pin adjacent said lower end;

a hollow cylindrical sleeve received for longitudinal sliding and rotational movement around said pin;

a right angle bracket having a first leg extending parallel with a longitudinal axis of said sleeve and secured thereto;

a second leg of said bracket extending perpendicular to the longitudinal axis of said sleeve;

a pair of spaced parallel side walls extending perpendicularly upwardly from opposed side edges of said second leg;

a spring roller type tape measure received on said second leg, between said parallel side walls;

a free end of a measuring tape of said tape measure secured to said sleeve;

a transversely extending cylindrical handle attached to an upper handle of said pin;

a card holder attached to said pin adjacent said handle; and means for holding a writing instrument on said card holder.

* * * * *